United States Patent [19]

Matsui

[11] Patent Number: 4,981,069

[45] Date of Patent: Jan. 1, 1991

[54] CYLINDER LOCKING DEVICE

[76] Inventor: Akio Matsui, 5, Nagara Ida, Gifu-shi, Gifu-ken, Japan

[21] Appl. No.: 369,158

[22] Filed: Jun. 21, 1989

[30] Foreign Application Priority Data

Jun. 23, 1988 [JP] Japan ..... 63-155569
May 16, 1989 [JP] Japan ..... 1-055987[U]

[51] Int. Cl.[5] ..... F15B 15/26

[52] U.S. Cl. ..... 92/028; 92/27; 92/24; 92/23; 92/15; 188/77 R

[58] Field of Search ..... 92/15, 18, 19, 20, 23, 92/24, 27, 28; 188/77 R

[56] References Cited

U.S. PATENT DOCUMENTS

| | | | |
|---|---|---|---|
| 3,033,175 | 5/1962 | Stott | 92/27 |
| 4,211,149 | 7/1980 | Hrusch | 92/27 |
| 4,700,814 | 10/1987 | Mitchell | 92/27 |
| 4,791,855 | 12/1988 | Matsui | 92/28 |

FOREIGN PATENT DOCUMENTS

| | | | |
|---|---|---|---|
| 0087255 | 8/1983 | European Pat. Off. | 92/28 |
| 197266 | 4/1958 | Fed. Rep. of Germany | 188/77 R |
| 1222755 | 8/1966 | Fed. Rep. of Germany | 92/28 |
| 2558142 | 7/1976 | Fed. Rep. of Germany | 188/77 R |
| 0166108 | 10/1983 | Japan | 92/27 |
| 135733 | 3/1961 | U.S.S.R. | 92/28 |

*Primary Examiner*—Edward K. Look
*Assistant Examiner*—Thomas Denion
*Attorney, Agent, or Firm*—Armstrong, Nikaido, Marmelstein, Kubovcik, & Murray

[57] ABSTRACT

A cylinder locking device comprises a thick cylindrical brake member whose inner diameter is slightly smaller than the outer diameter of a piston rod to be locked. The cylindrical brake member is disposed in a casing and fitted on the piston rod, and has a slit opening formed axially therein. Two receive rollers are disposed oppositely and rotatably on both margins of the slit opening. An actuator having a tapered portion is disposed in the casing. The locking of the piston rod is released when the tapered portion is forced in between the receive rollers to expand the cylindrical brake member. When the actuator is not in actuation, the piston rod is strongly gripped and locked by the elasticity in the diameter-decreasing direction of the cylindrical brake member.

4 Claims, 2 Drawing Sheets

CYLINDER LOCKING DEVICE

BACKGROUND OF THE INVENTION

1. Field of the Invention

This invention relates to a cylinder locking device for locking and keeping stationary the piston rod of a hydraulic cylinder at a desired position.

2. Description of the Prior Art

Conventional cylinder locking devices of the foregoing type are typically constructed such that a brake member having an eccentric hole is fitted rotatably on a piston rod and when locking the piston rod, the brake member is rotated about an axis eccentric to the axis of the piston rod. However, since the piston rod is locked by the eccentric rotation of the brake member, the piston rod deforms as being twisted; consequently, shearing force is generated in the piston rod, or a bearing portion of the piston rod is deformed or worn.

In view of the above, the present inventor has proposed in U.S. Pat. No. 4,791,855 a cylinder locking device which is capable of locking the piston rod of a hydraulic cylinder at a desired position without accompanying deformation of the piston rod and wear of bearings. This cylinder locking device is constructed such that two semicylindrical brake members are formed by dividing a thick cylinder having eccentric outer and inner circumferential portions axially into two halves at its thickest and thinnest portions, the two brake members are disposed rotatably in a housing, the piston rod is disposed inside the two brake members, and when locking the piston rod, the two semicylindrical brake members are rotated in opposite directions.

The foregoing locking device including the two semicylindrical brake members can attain locking without giving shearing force or the like to the piston rod. However, a coiled spring for urging the two semicylindrical brake members in their locking directions and an actuator for urging them in their unlocking directions become large in size; thus, the locking device as a whole becomes large in size and becomes complicated in structure.

SUMMARY OF THE INVENTION

It is an object of the present invention to provide a cylinder locking device which can be simplified and made compact in structure.

In brief, a cylinder locking device according to the present invention is constructed such that a thick cylindrical brake member whose inner diameter is slightly smaller than the outer diameter of a piston rod to be locked is disposed in a casing and fitted on the piston rod, the cylindrical brake member has a slit opening formed axially therein, two receive rollers are disposed oppositely and rotatably on both margins of the slit opening, and an actuator having a tapered portion is disposed in the casing. The locking of the piston rod is released when the tapered portion is forced in between the receive rollers to expand the cylindrical brake member.

When the actuator is not in actuation, the piston rod of a cylinder is locked and kept stationary because the cylindrical brake member tightly fits on the piston rod or imposes its strong elasticity in the diameter-decreasing direction thereon.

When the actuator is actuated, the tapered portion is forced in between the two receive rollers disposed on both margins of the slit opening of the cylindrical brake member to expand the cylindrical brake member. As a result, the cylindrical brake member expands at its opening margins very slightly (on the order of 0.1 to 0.2 mm, for example), whereby the locking of the piston rod is released and the piston rod is put in a movable state.

DESCRIPTION OF THE PREFERRED EMBODIMENTS

Embodiments of the present invention will now be described with reference to the drawings.

Figure 1:
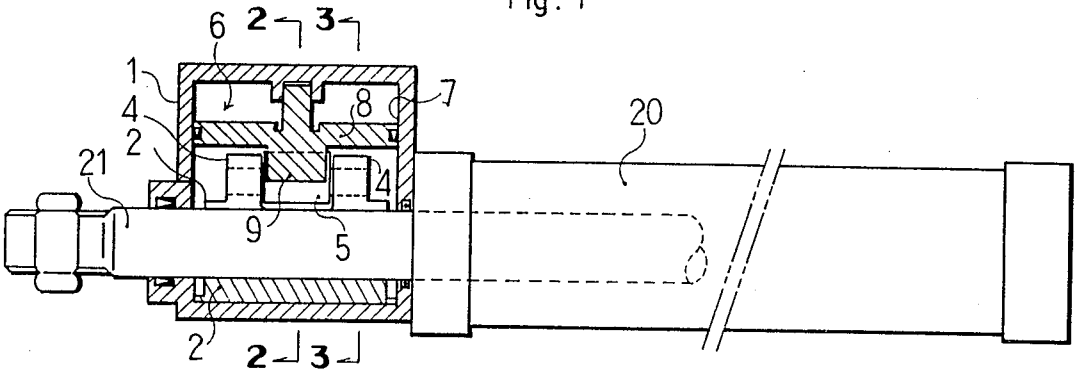
FIG. 1 is a side view, partly in cross section, showing an embodiment of a cylinder locking device according to the present invention.

As shown in FIG. 1, a casing 1 of a cylinder locking device is secured to the front end of a hydraulic cylinder 20, and a piston rod 21 to be locked passes through a lower section of the casing 1 having a rectangular box shape.

A cylindrical brake member 2 is disposed in the casing 1 and tightly fitted on the piston rod 21. This cylindrical brake member 2 is molded into a thick cylindrical shape by cast iron, gun metal or the like such that its inner diameter becomes slightly smaller than the outer diameter of the piston rod 21, and has a slit opening 3 formed axially in an upper portion thereof. Formed projectingly on both margins of the slit opening 3 are two pairs of opposed bearing portions 4. In case the piston rod 21 of Dmm in outer diameter is produced with a tolerance of 0.00 to −0.05 mm, the cylindrical brake member 2 is molded such that its inner diameter becomes slightly smaller than the outer diameter of the piston rod or falls within the range of from D−0.10 mm to D−0.15 mm.

Receive rollers 5 extending in parallel are supported rotatably by the opposed bearing portions 4 of two pairs formed projectingly on the cylindrical brake member 2 such that they can rotate on both margins of the slit opening 3. Specifically, these receive rollers 5 are disposed such that a tapered portion (for lock releasing) described hereinafter can contact with them with a very small friction. Each receive roller is constructed such that a metallic cylinder is supported via bearing portions such as ball bearings by a shaft passing therethrough or such that both end portions of a metallic roller are supported by bearing portions such as ball bearings.

Figure 2:
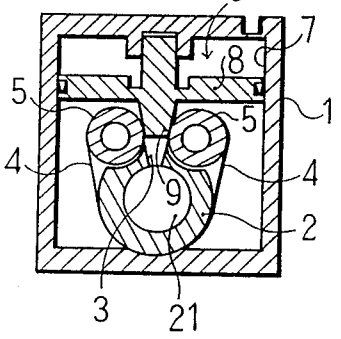
FIG. 2 is a sectional view taken along line II—II of FIG. 1.
Figure 3:
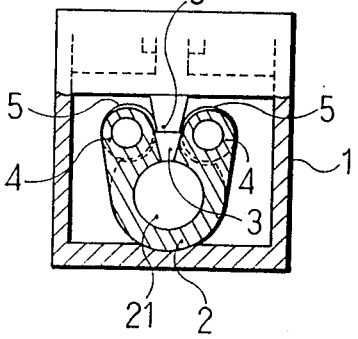
FIG. 3 is a sectional view taken along line III—III of FIG. 1.

In an upper section of the casing 1, there is provided an actuator 6 which faces down and is of the form of a fluid-actuated piston cylinder. Specifically, the actuator 6 is composed of a short cylinder 7 and a piston 8 of short stroke fitted in the cylinder 7. The piston 8 has a tapered portion 9 projecting in an under central portion thereof. This tapered portion 9, as shown in FIG. 2, is shaped such that its both side surfaces are inclined to progressively decrease the width as approaching its distal end, and is disposed so as to widen the spacing between the receive rollers 5 and 5 when forced in therebetween.

When the tapered portion 9 of the actuator 6 is forced in between the receive rollers 5, the cylindrical brake member 2 is expanded, whereby the locking is released. In this regard, it is sufficient that the cylindrical brake member 2 exhibits a slight width of expansion (on the order of 0.1 to 0.2 mm, for example), thus, where the width of expansion of the recieve rollers 5 is 1 to 2 mm, it is sufficient that the stroke of the piston 8 of the actuator 6 is on the order of a few millimeters. Therefore, the actuator 6 can be made thin and miniaturized. As will be appreciated, the piston 8 of the actuator 6 is pushed up to return to its non-actuated position by the spring force of the cylindrical brake member 2 when not in actuation. In this connection, a coiled spring (for returning) may be disposed in the actuator 6 such that when no fluid pressure is applied, the coiled spring returns the piston 8 upward and to the non-actuated position.

The operation of the cylinder locking device of the foregoing structure will now be described.

When the actuator 6 is not in acutation, the cylindrical brake member 2 whose inner diameter is slightly smaller than the outer diameter of the piston rod 21 of the cylinder 20 is tightly fitted on the piston rod 21, or the cylindrical brake memeber 2 exhibits its strong elasticity in the diameter-decreasing direction; as a result, the piston rod 21 is locked and kept stationary. In case the cylindrical brake member 2 is made of cast iron whose inner diameter is 20 mm, thickness is 20 mm, and length is 80 mm, its brake retaining force is about 300 kgf. This retaining force is two times the motive force (about 150 Kgf) of the cylinder whose tube inner diameter is 63 mm, thus is sufficient as the brake retaining force.

On the other hand, when fluid pressure is applied through a port into the cylinder 7 of the actuator 6, the piston or its tapered portion 9 moves down and enters between the receive rollers 5 and 5 to expand the spacing therebetween. As a result, the cylindrical brake member 2 is elastically deformed to expand a little by means of the tapered portion, so that the locking of the piston 21 is released and the piston 21 is put in a workable state. Since the expansion of the cylindrical brake member 2 is a little, not exceeding its limit of elastic deformation, when the actuator 6 is put in the non-acuated state, the tapered portion 9 is pushed up by the elasticity of the cylindrical brake member, the cylindrical brake member 2 deforms again in the diameter-decreasing direction to grip and lock the piston rod 21.

As described above, according to the cylinder locking device of the present invention, the brake member can be simplified in sturcture or made of a cylinder with a slit formed therein, the stroke of the actuator can be made very short because the brake can be released only by slightly expanding the cylindrical brake member, and the overall size can be miniaturized. Further, since the cylindrical brake member returns to its locking state by virtue of its elasticity, a coiled spring or the like for returining is not required; thus the device can be further simplified in structure.

Figure 4:
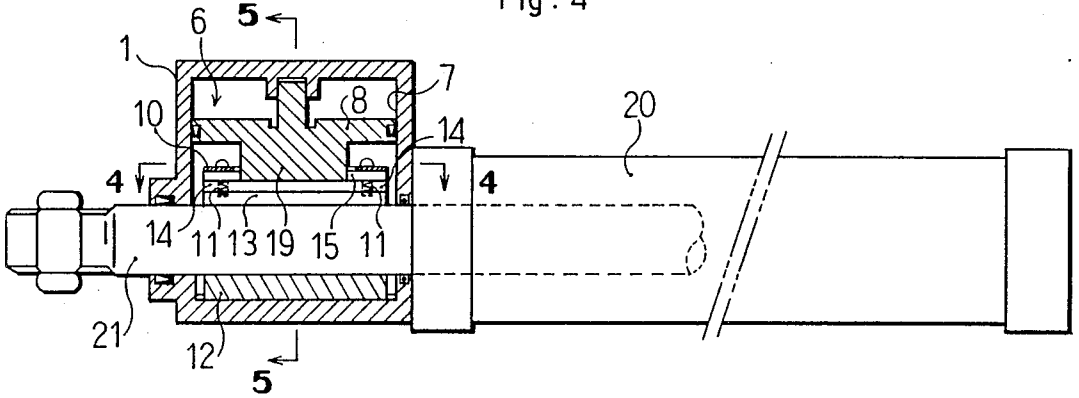
FIG. 4 is a side view, partly in cross section, showing another embodiment of the cylinder locking device according to the present invention.
Figure 6:
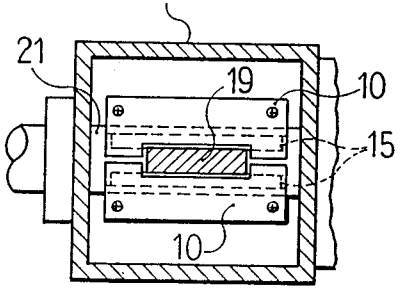
FIG. 6 is a sectional view taken along line VI—VI of FIG. 4.
Figure 5:
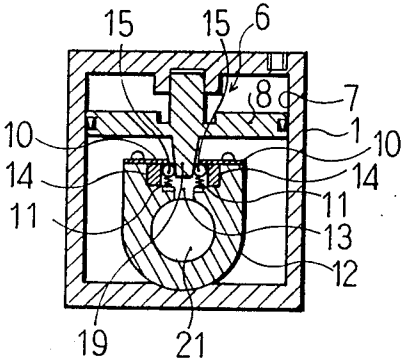
FIG. 5 is a sectional view taken along line V—V of FIG. 4.

FIGS. 4 through 6 show another embodiment of the cylinder locking device.

Similarly to the first embodiment, a casing 1 of this second embodiment is secured to the front end of a hydraulic cylinder 20, and a piston rod 21 to be locked passes through a lower section of the casing 1 having a rectangular box shape.

A cylindrical brake member 12 is disposed in the casing 1 and tightly fitted on the piston rod 21. This cylindrical brake member 12 is molded into a thick cylindrical shape by cast iron, gun metal or the like such that its inner diameter becomes slightly smaller than the outer diameter of the piston rod 21. In case the piston rod 21 of Dmm in outer diameter is produced with a tolerance of 0.00 to −0.05 mm, the cylindrical brake memeber 12 is molded such that its inner diameter becomes slightly smaller than the outer diameter or falls within the range of from D−0.10 mm to D−0.15 mm.

The cylindrical brake member 12 has a slit opening 13 formed axially in an upper portion thereof. Further, each marginal upper portion of the slit opening 13 is cut off to leave a U-shaped recess, and a quenched stiffening plate 14 of high hardness is fitted to each recess. A support plate 10 for supporting a receive roller 15 hereinafter described is screwed to the upper end of each margin of the opening of the cylindrical brake member 12.

Formed in a central portion of the combination of support plates 10 is an elongate opening through which a tapered portion 19 hereinafter described passes. Paired receive rollers (quenched metallic round bars) 15 are disposed shiftably and rotatably in the recesses in paralle and oppositely to each other. Specifically, each of the paired receive rollers 15 is vertically rollably inserted in place in the state wherein it is held in contact with the stiffening plate 14 under the support plate 10 and urged upward by multiple coiled springs 11. These coiled springs 11 are supported vertically in holes bored in both marginal portions of the slit opening 13 of the cylindrical brake member 12.

The receive rollers 15 are disposed such that the tapered portion 19 (for lock releasing) can contact with them with a very small friction.

In an upper section of the casing 1, there is provided an actuator 6 which faces down and is of the form of a fluid-actuated piston cylinder. Specifically, the actuator 6 is composed of a short cylinder 7 and a piston 8 of short stroke fitted in the cylinder 7. The piston 8 has the tapered portion 19 projecting in an under central portion thereof. This tapered portion 19, as shown in FIG. 5, is shaped such that its both side surfaces are inclined to progressively decrease the width as approaching its distal end, and is disposed so as to widen the spacing between the receive rollers 15 and 15 when forced in therebetween.

When the tapered distal end portion 19 of the actuator 6 is forced in between the receive rollers 15, the cylindrical brake member 12 is expanded, whereby the locking is released. In this regard, it is sufficient that the cylindrical brake member 12 exhibits a slight width of expansion (on the order of 0.1 to 0.2 mm, for example); thus, where the width of expansion of the receive rollers 15 is 1 to 2 mm, it is sufficient that the stroke of the piston 8 of the actuator 6 is on the order of a few millimeters. Therefore, the actuator 6 can be mede thin and miniaturized.

Since the receive rollers 15 are disposed for the purpose of reducing the friction drag of the tapered portion 19, they demand no bearings and may be made of thin round bars; thus, this section inclusive of the receive rollers can be miniaturized, leading to miniaturization of the whole cylinder locking device.

The operation of this second embodiment is identical with that of the first embodiment. That is, when the actuator 6 is not in acutation, the piston 21 is strongly gripped and locked by the elasticity in the diameter-decreasing direction of the cylindrical brake member 12. On the other hand, when the actuator 6 is actuated, its piston or tapered portion 19 moves down and enters between the receive rollers 15 and 15 to expand the spacing therebetween. As a result, the cylindrical brake member 12 is elastically deformed to expand a little by means of the tapered portion, so that the locking of the piston 21 is released and the piston 21 is put in a workable state.

As described above, according to the cylinder locking device of the present invention, the brake member can be simplified in structure or made of a cylinder with a slit formed therein, the stroke of the actuator can be made very short because the brake can be released only by slightly expanding the cylindrical brake member, and the overall size can be miniaturized. Further, since the cylindrical brake member returns to its locking state by virtue of its elasticity, a coiled spring or the like for returning is not required; thus the device can be further simplified in structure.

Further, the receive rollers disposed for the purpose of reducing the friction drag of the tapered portion may be made of thin round bars with no support shafts, not demanding any bearings; thus, this section inclusive of the receive rollers can be miniaturized, leading to miniaturization of the whole cylinder locking device.

What is claimed is:

1. A cylinder locking device comprising a casing secured at an end of a hydraulic cylinder, a thick cylindrical brake member disposed in said casing and having an inner diameter slightly smaller than the outer diameter of a piston rod to be locked and a slit opening formed axially therein, said brake member being fitted on said piston rod, receiving rollers disposed oppositely and rotatably on opposite margins of said slit opening, and an actuator disposed in said casing and having a movable tapered portion beteen said rollers, said brake member locking said piston rod being released when said tapered portion of said actuator is forced between said receiving rollers and expands said cylindrical brake member.

2. A cylinder locking device according to claim 1, wherein said actuator is a fluid-actuated piston cylinder, and said tapered portion is formed under a central portion of said piston of said actuator.

3. A cylinder locking device according to claim 1, wherein, said receiving rollers are supported rotatably on bearing portions of said cylindrical brake member.

4. A cylinder locking device according to claim 1, wherein said receiving rollers are made of thin round bars, and supported rotatably and shiftably by multiple coiled springs and support plates on opposite margins of said slit opening.

* * * * *